US005641141A

United States Patent [19]

Goodwin

[11] Patent Number: 5,641,141

[45] Date of Patent: Jun. 24, 1997

[54] ANTENNA MOUNTING SYSTEM

[75] Inventor: Gordon D. Goodwin, Coarsegold, Calif.

[73] Assignee: AT&T Wireless Services, Inc., Kirkland, Wash.

[21] Appl. No.: 466,032

[22] Filed: Jun. 6, 1995

[30] Foreign Application Priority Data

Oct. 6, 1994 [WO] WIPO ..... PCT/US94/11336

[51] Int. Cl.[6] ..... A47K 1/00

[52] U.S. Cl. ..... 248/218.4; 343/879

[58] Field of Search ..... 343/879, 890, 343/891, 892; 248/218.4, 219.1, 219.2, 230.1, 220.21; 52/40, 721.1, 720.1

[56] References Cited

U.S. PATENT DOCUMENTS

| | | | |
|---|---|---|---|
| 2,655,600 | 10/1953 | Hillison | 343/879 X |
| 3,530,996 | 9/1970 | Schaffer . | |
| 3,623,116 | 11/1971 | Green et al. | 343/879 X |
| 4,214,841 | 7/1980 | Hayashi | 403/188 |
| 4,300,852 | 11/1981 | Clark | 403/385 |
| 4,301,457 | 11/1981 | Bogner | 343/891 X |
| 4,745,412 | 5/1988 | Creaser, Jr. | 343/890 |
| 4,755,830 | 7/1988 | Plunk | 343/890 |
| 4,842,231 | 6/1989 | Warshawsky | 248/316.2 |
| 4,928,911 | 5/1990 | Hardtke | 248/74.1 |
| 5,193,774 | 3/1993 | Rogers | 248/219.4 |
| 5,204,688 | 4/1993 | Loiseau et al. | 343/800 |
| 5,291,211 | 3/1994 | Tropper | 343/890 |
| 5,320,312 | 6/1994 | Hoenninger | 248/230.1 X |

OTHER PUBLICATIONS

City of Fresno, California, Conditional Use Permit Application received by the City of Fresno on Jul. 12, 1993 and assigned Application No. C-93-41.

Notice of Public Hearing, Conditional Use Permit No. C-93-41 from Fresno City Planning Commission.

Fresno City Planning Commission, Resolution 10562 dated Oct. 20, 1993.

Memo to Mr. Gordon Goodwin, Cellular One, from Karl K. Tashjian, dated Sep. 7, 1993, Subject: Antenna Mount Sleeve.

Fresno Bee Newspaper Article dated Oct. 28, 1993.

*Primary Examiner*—Ramon O. Ramirez

*Attorney, Agent, or Firm*—Knobbe, Martens, Olson & Bear, LLP

[57] ABSTRACT

An antenna assembly comprising a pole and an antenna mounting apparatus. The antenna mounting apparatus is comprised of at least one sleeve which is configured to be mounted on the pole. Advantageously, the sleeve includes three antenna mounting members which extend in a direction parallel to the pole. Flat panel directional antennas are then attached to the antenna mounting members in a manner where the antennas also extend in a direction parallel to the pole to thereby minimize the horizontal profile of the antenna mounting apparatus. The sleeve can be mounted on a support collar positioned on the pole and can be rotated about the support collar to a desired rotational orientation and then secured in the desired rotational orientation. A further embodiment of the present invention incorporates two sleeves, which can be positioned at different positions on the pole, with the at least one antenna mounting member extending therebetween.

52 Claims, 12 Drawing Sheets

ANTENNA MOUNTING SYSTEM

BACKGROUND OF THE INVENTION

1. Field of the Invention

The present invention relates to an apparatus and method of mounting an antenna on a pole and, in particular, concerns an apparatus for mounting one or more antenna members, each having one or more antenna elements, on a pole in an aesthetically pleasing fashion.

2. Description of the Related Art

Mobile communication devices such as cellular telephones, pagers and the like are now commonly used throughout most of the industrialized world. These types of devices require that there be base stations with associated antenna assemblies positioned throughout the operational area of the mobile devices. Communication signals can then be passed between the mobile devices and a fixed communication system, e.g., the publicly switched telephone network. Increasingly, mobile communication devices are being used in urban and residential areas which require that base stations also be positioned in these areas. One difficultly that occurs, especially when base stations are placed in residential areas, is that large, often unsightly antenna structures, which form a necessary component of the typical base station, must also be placed in these areas.

A typical antenna structure used for cellular telephone communications is comprised of a vertical tower or pole on top of which sits an array of antennas. The antenna array is usually designed to provide 360° coverage so that communication signals can be transmitted to, and received from, mobile units located in any direction from the base station. One common manner of providing the 360° coverage is to assign one or more receive antennas and one or more transmit antennas to carry the communication signals between the base station and the mobile units located within a particular arc of directions. For example, one common scheme is to assign three groups of directional transmit and receive antennas to each cover a 120° arc to thereby provide 360° of communication coverage.

In these types of prior art antenna assemblies, there are generally at least two receive antennas which must be positioned a certain distance from each other to avoid interference between communications carried by each antenna. In fact, the receive antennas covering a single 120° arc quite often have to be positioned more than 15 feet apart to optimize the signal carrying capacity of these antennas. This separation of the receive antennas requires that the antenna tower include a horizontal structure positioned on the top of the tower so that the receive antennas can be horizontally spaced from each other. Unfortunately, this horizontal structure is generally very heavy and requires that the tower or pole supporting the antenna array be large enough to support, not only the weight of the antennas, but also the weight of the horizontal support structure. Consequently, the typical prior art antenna tower is generally very large and obtrusive due to the horizontal structure and multiple antennas positioned on top of the tower.

It can be appreciated that installation of an antenna tower of this type can be very complex and expensive. Specifically, a pole or tower of sufficient strength and size to support the horizontal support structure and the antennas must first be erected. Generally, these towers are either large diameter poles or assembled multi-piece towers like those used for high tensions transmission lines. Once the tower is erected, the horizontal structure then has to be constructed and attached to the tower. Often this can only be accomplished once the tower has been erected which requires that the workers assemble the horizontal support structure and mount the antennas while suspended up in the air adjacent the top of the tower.

Further, once the horizontal support structure and antennas are mounted, it is difficult to reorient the position of the antennas. Ideally, a directional antenna is exactly positioned so that its transmission or reception capabilities are maximized. Often it is necessary to reorient the antenna to maximize its capabilities as a result of changes in the environment surrounding the antenna tower. For example, the addition of other communication devices in the vicinity of the antenna tower may create communication difficulties for the antenna tower which could be overcome by repositioning or reorienting the antennas. The complexity and size of the horizontal support structure makes reorienting the antennas a difficult task.

Furthermore, the antenna towers of the prior art are also viewed as an eyesore in residential communities. The size of the tower and the horizontal structure on the top of the tower produces a very obtrusive visual appearance which is generally inconsistent with the appearance of other objects positioned in the residential area, such as traffic lights, street lights and the like. Consequently, many governmental agencies have begun to severely limit the ability of cellular communication companies to install these antenna towers especially in or near residential areas.

Hence, there is a need in the prior art for an antenna mounting apparatus or system which allows directional antennas to be easily mounted on the top of poles, so as to provide communications over a desired arc, without resulting in antenna towers having an unsightly appearance. Further, there is also a need in the prior art for an antenna mounting system which will allow for easy installation, orientation and adjustment of an array of antennas on existing poles.

SUMMARY OF THE INVENTION

The aforementioned needs are satisfied by the assembly of the present invention which is essentially comprised of a pole and an equipment mounting apparatus. It is one aspect of the present invention that the equipment mounting apparatus is comprised of an antenna mounting apparatus which is essentially comprised of one or more mounting sleeves which are also configured to be mounted on a pole. The mounting sleeve has one or more antenna mounts whereby directional antenna elements can be attached to the antenna mounts so that the antenna elements are spaced apart in a direction which is substantially parallel to the pole to thereby minimize the horizontal profile of the antennas and antenna mounting apparatus. The mounting sleeves are preferably configured so that the antenna elements can be oriented in a desired direction by simply rotating the mounting sleeves on the support members. The antenna mounting apparatus includes securing devices which, once the antenna elements are in a desired orientation, can be used to secure the antenna elements in the desired orientation. The antenna mounting apparatus of the present invention can be easily installed on either an existing light or power pole or the existing pole can be replaced with a pole especially designed to be used as a platform for one or more communications antennas.

In one particular aspect of the present invention, each of the antennas are mounted substantially adjacent and parallel to a pole. Further, the antennas can also be comprised of a generally rectangular bar shape antenna member which can be mounted so that it extends in a direction substantially parallel to the direction of the pole. The antenna members can be configured so that one end comprises a first receive antenna and the other end comprises a second receive antenna and the center section, interposed between the first and second ends, comprises the transmit antenna. By mounting this type of antenna in a direction which is parallel to the pole in this way, separation can be maintained between the receive antennas, to thereby minimize interference between the two receive antennas, without requiring an elaborate structure to horizontally support the receive antennas. Consequently, a smaller pole can be used to support the antenna mounting apparatus and the antenna assembly presents a more aesthetically pleasing appearance.

In one preferred embodiment of the present invention, the mounting sleeve is supported on the pole by a support member which is comprised of a collar that is mounted near the top of a cylindrical pole. In this embodiment, there is a single mounting sleeve which is generally cylindrical in shape. The mounting sleeve is then positioned on the pole supported by the collar. The mounting sleeve has a plurality of antenna mounts which are equally spaced about the outside of the sleeve. In one preferred embodiment, the antenna members are mounted on the antenna mounts so that any required separation between antennas is provided in a direction which is substantially parallel to the pole. Preferably, the cables that connect to the antennas are run through the center of the pole and exit out of the top of the pole and are then connected to the antennas mounted on the antenna mounts. This embodiment of the mounting sleeve preferably includes one or more locking bolts which extend through the walls of the sleeve and can be tightened against the pole to thereby secure the sleeve in a desired rotational orientation.

Hence, one particular aspect of the present invention is mounting an array of antennas by positioning a support member on a pole, mounting a sleeve having a plurality of antenna mounts on the pole so that it is supported by the support member, attaching antenna members to the antenna mounts so that the antenna members extend in a direction parallel to the pole, orienting the sleeve to get a desired rotational orientation for the antennas and then securing the sleeve in this orientation.

Another preferred embodiment of the antenna mounting apparatus includes two sleeves which are configured to be mounted to a pole. Each of the two sleeves rests on a support member and each of the sleeves includes brackets configured to receive or act as antenna mounts. The antenna members are then attached to the antenna mounts so that the antenna members extend between brackets on the two sleeves. In this preferred embodiment, the sleeves can be positioned on the pole in different relative positions. This allows this embodiment of the antenna mounting apparatus to be attached to smaller areas of the pole and to be adjusted to accommodate different sizes of antenna members or an antenna array requiring different separation distances.

In yet another preferred embodiment, the two sleeves are comprised of a plurality of pieces which can be connected together to form the sleeve. The pieces forming the sleeve are interconnected so that they can be tightened to thereby reduce the inner diameter of the sleeve. The sleeves can then be connected together around the pole and tightened to secure the sleeves to the pole. The sleeves include brackets which can either receive or function as antenna mounts. Once the sleeves are securely mounted on the pole, antenna mounts can be connected to each of the sleeves and antennas can then be mounted on the antenna mounts. The antenna mounting apparatus in this particular embodiment can thus be mounted on a pole without requiring the sleeve to be slid over the top of the pole. Further, the antenna mounting apparatus in this particular embodiment can also be adapted to receive antenna members of different size.

These and other objects and features of the present invention will become more fully apparent from the following description and appended claims taken in conjunction with the accompanying drawings.

DESCRIPTION OF THE PREFERRED EMBODIMENTS

Figure 1:
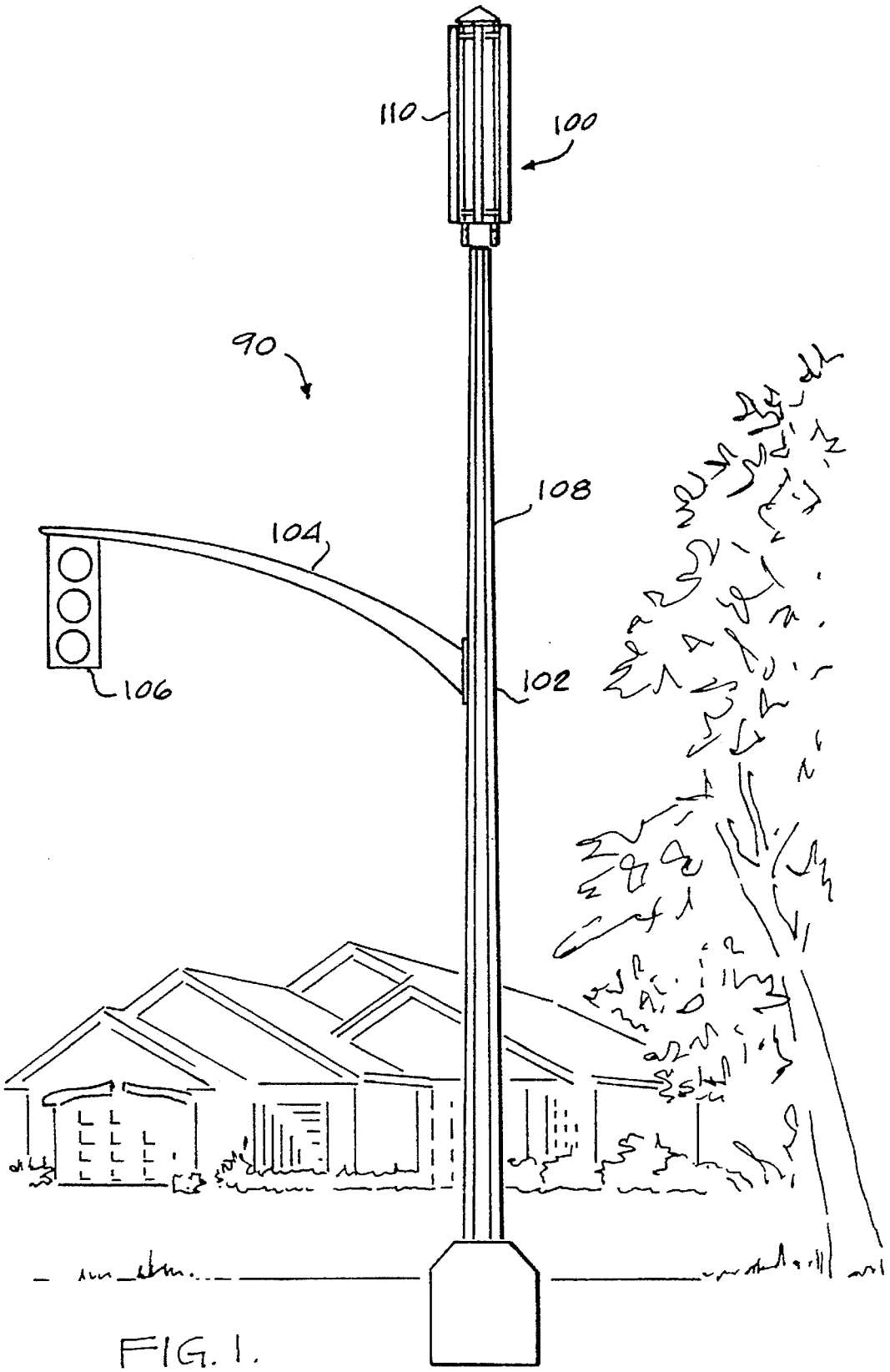
FIG. 1 is a perspective view of a first embodiment of an antenna mounting apparatus mounted on a pole which also contains a stop light.

Reference will now be made to the drawings wherein like numerals refer to like parts. FIG. 1 is a perspective view of an assembly 90 of the present invention which is comprised of one preferred embodiment of an equipment mounting apparatus 100 and support pole 102. In one embodiment, the assembly 90 is an antenna assembly and the equipment mounting apparatus is configured to be an antenna mounting apparatus 100, however, it should be appreciated that the present invention can be adapted to mount other pieces of equipment. In the embodiment shown in FIG. 1, the support pole 102 includes a horizontal section 104 on which is mounted a stoplight 106. In one aspect of the present invention, the antenna mounting apparatus 100 is designed to be mounted unobtrusively on existing, or newly installed, power, light and utility support poles to minimize the visual impact of the antenna mounting apparatus 100. The term support pole 102 shall be used generically in this specification to refer to these types of poles. The embodiment shown in FIG. 1 can either result from adding a vertical section 108 of the support pole 102 to an existing stoplight pole or by replacing an existing stoplight pole with the support pole 102.

FIG. 1 illustrates that this embodiment of the antenna mounting apparatus 100 is mounted on the top of the vertical section 108 of the pole 102. Preferably, the antenna mounting apparatus 100 is positioned high enough to allow the antennas on the antenna mounting apparatus 100 to provide adequate communications within a selected radial distance. In one preferred embodiment, the antenna mounting apparatus 100 is mounted on the top eight to ten feet (8' to 10') of a sixty foot (60') pole which generally provides for adequate communications within a suitable radius. Preferably, similar antenna mounting apparatuses 100 are positioned on poles throughout an entire geographic region to provide nearly seamless coverage for the geographic region.

The antenna mounting apparatus 100 shown in FIG. 1, provides mounts for three antenna members 110. The three antenna members 110 are preferably positioned at 120° intervals around the pole 102 so that the three antenna members 110 can, collectively, transmit and receive signals from mobile units located within range of the antennas throughout an entire 360° arc. The preferred antenna member 110 used in this embodiment will be described in greater detail in reference to FIGS. 2 and 3 below.

Figure 2:
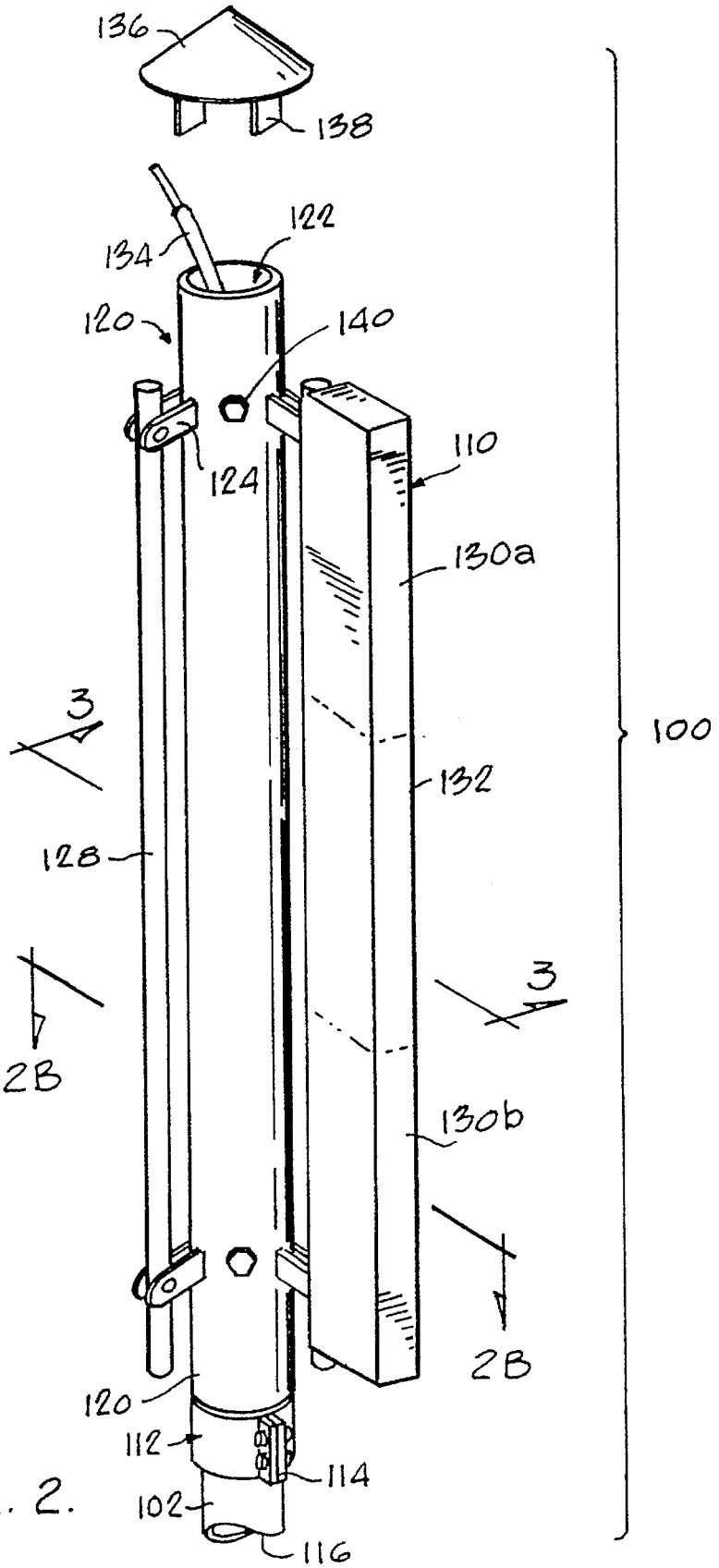
FIG. 2 is a partial perspective view of the pole and apparatus of FIG. 1 which illustrates the antenna mounting apparatus in greater detail.
Figure 2A:
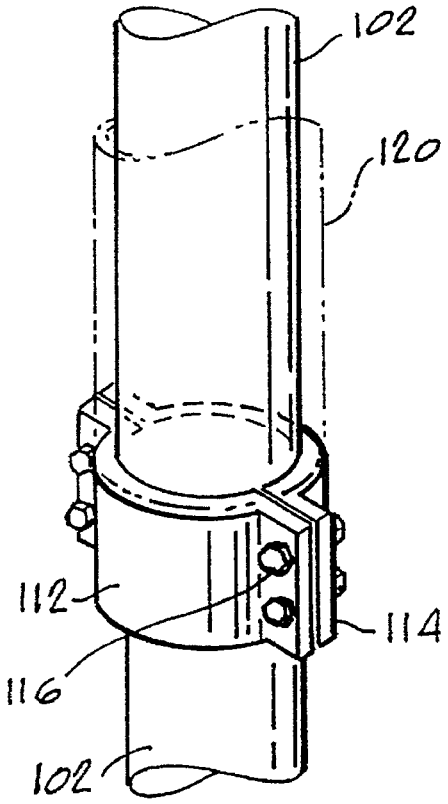
FIG. 2A is a detail view of the apparatus shown in FIG. 2 which illustrates a support collar in greater detail.

FIGS. 2, 2A–2C and 3 illustrate the antenna mounting apparatus 100 in greater detail. The antenna mounting apparatus 100 includes a support member 112 which is, in this embodiment, comprised of a collar that is attached to the pole 102. In one preferred embodiment, the pole 102 is slightly tapered, i.e., the diameter of the pole 102 decreases slightly towards the top of the pole 102. As shown in FIG. 2A, the support collar 112 in this preferred embodiment is comprised of two half circles with flanges 114 that can be positioned around the pole 102 and then bolted together with two bolts 116 to secure the support collar 112 to the pole 102. Preferably, the inner diameter of the support collar 112 and the outer diameter of the pole 102 are selected so that the support collar 112 can be positioned around the pole 102 and secured in this position to thereby support the weight of the rest of the antenna mounting apparatus 100 and antenna members 110 in the manner described below.

In this preferred embodiment, the support collar 112 is made from a piece of steel tube which is preferably 9 inches in diameter, 5 inches in length and 1 inch in thickness. This is for the pole used in this embodiment which is roughly 9 inches in diameter at the position of the support collar 112 and is gradually tapered to approximately 7.6 inches at the top of the pole. Naturally, the size of the support collar 112, and the other components of the antenna mounting apparatus can be adapted to be mounted on poles of different diameters and different degrees of tapering (including no tapering). The pipe tube is cut in half and the flanges 114 are preferably welded to each end of the half circle of pipe tube. The support collar 112 is preferably securely mounted on the pole approximately 10 feet from the top of the pole 102.

Figure 2C:
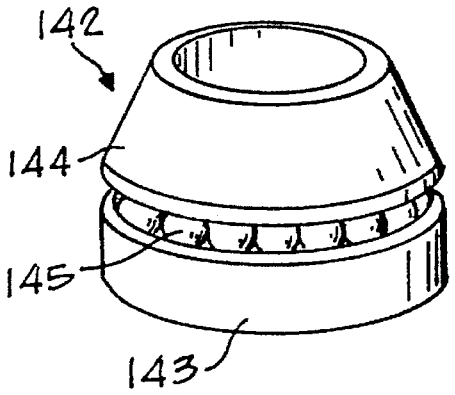
FIG. 2C is a perspective view of a self-centering bearing surface which can be used in conjunction with the apparatus shown in FIG. 2.
Figure 2B:
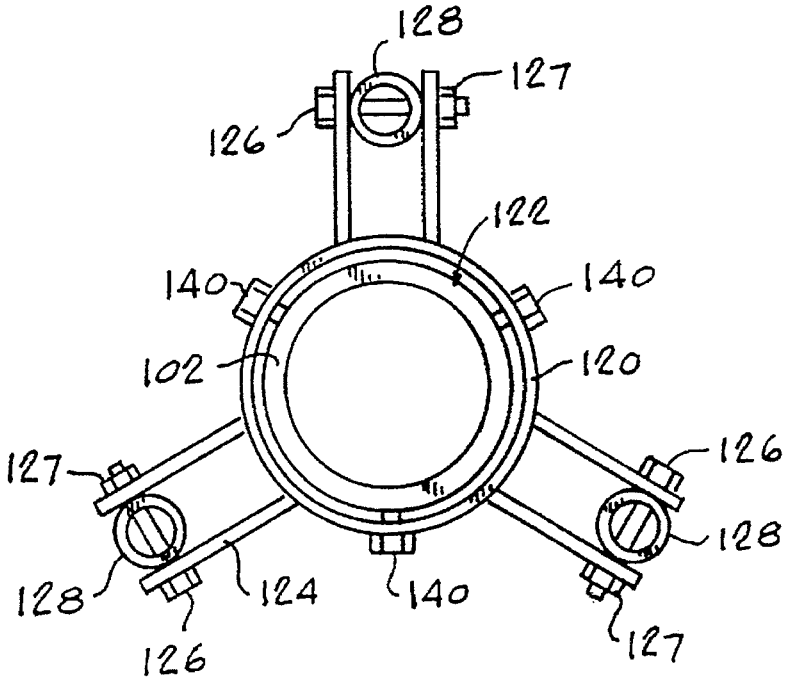
FIG. 2B is a sectional top view of the apparatus shown in FIG. 2, taken along the lines 2B—2B.

Referring to FIGS. 2 and 2B, the antenna mounting apparatus 100 also includes a sleeve 120 which is preferably a cylindrical member that has an inner diameter which is slightly greater than the outer diameter of the top portion of the pole 102. The sleeve 120 is positioned on the pole 102 so that the pole extends through a center opening 122 in the sleeve 120. In this preferred embodiment, the sleeve 120 is comprised of a cylindrical aluminum tube which is approximately 8 feet in length, has an inner diameter of approximately 9 inches, and a wall thickness of ¼ of an inch. The sleeve 120 in this preferred embodiment is configured to be positioned over the top of the pole 102 so that it rests upon, and is supported by, the support collar 112. It can be appreciated that the tapering of the pole 102 permits easier installation of the sleeve 120 as the center opening 122 in the sleeve is larger than the pole 102 at the top of the pole 102 which facilitates positioning the sleeve 120 over the top of the pole 102.

Three pairs of brackets 124 are preferably fixedly attached to the sleeve 120 at either end of the sleeve 120. The brackets 124, in this preferred embodiment, are positioned at approximately 120° intervals around the top and bottom of the sleeve 120 so that the brackets 124 at either end of the sleeve 120 are substantially aligned. In this preferred embodiment, the brackets 124 are made of aluminum and are positioned approximately 6 inches from the top and bottom of the sleeve 120. Further, the brackets 124 extend outward from the sleeve approximately 6 inches and are approximately 2 inches wide and ½ inch thick. The brackets 124 in each pair are preferably aligned and separated by approximately 1 inch and each bracket contains a bolt hole (not shown) through which extends a bolt 126.

An antenna mounting member 128 is positioned between each pair of brackets 124 so that there are three antenna mounting members 128 which extend parallel to the pole 102, substantially the entire length of the sleeve 120, and are positioned at 120° intervals about the sleeve 120. In this preferred embodiment, the antenna mounting members 128 are comprised of 7-foot lengths of 1½ inch thick aluminum tube which are pressed into the pairs of brackets 124 at either end of the sleeve 120 and secured therein by the bolt 126 and a lock nut 127 (FIG. 2B).

Figure 3:
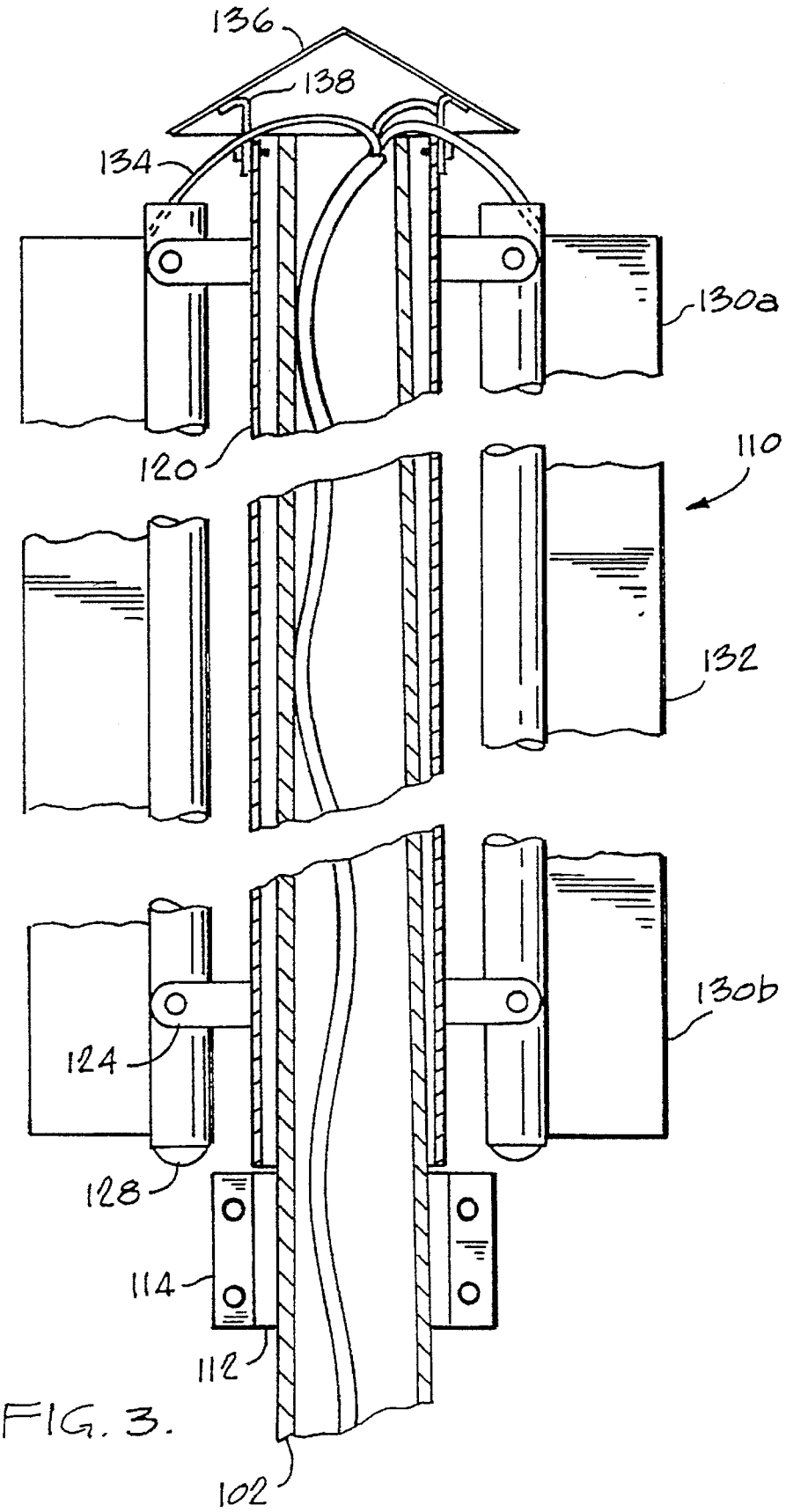
FIG. 3 is a side cut-a-way view of the antenna mounting apparatus shown in FIG. 2, taken along the lines 3—3 in FIG. 2.

The antenna members 110 can then be mounted on the antenna mounting members 128. Each antenna member 110 in this preferred embodiment is comprised of a generally rectangular bar that is approximately 9 feet in length, one-foot wide and several inches thick. Further, as illustrated in FIG. 3, each antenna member 110 preferably includes two receive antennas **130*a* and 130*b* positioned at the ends of the antenna array 110 and a transmit antenna 132 interposed between the two receive antennas 130*a* and 130*b*. The antenna members 110 are mounted on the antenna mounting members 128 and are secured thereto in any of a number of well known manners. Hence, in this preferred embodiment, the antenna members 110** are generally a single, rectangular, bar containing two receive antenna elements and a single transmit antenna element.

Antennas of this shape are preferred as they provide an aesthetic appearance which is more consistent with the appearance of other commonly seen objects in a residential and urban environment. Suitable antenna members of this type are generally referred to as flat panel directional antennas and are available from the Decibel Products division of the Allan Telecom Group, located in Dallas, Tex., under the series designations of DB 870 and DB 880. The above-described antenna mounting system 100 can thus support this type of antenna array and maintain separation between the two receive antenna elements **130*a* and 130*b* to minimize interference between the two receive antennas 130*a* and 130*b***.

Further, the aesthetic appearance of the antenna mounting apparatus 100 of the present invention is also heightened by the mounting position of the antenna members 110. Not only do the antenna members 110 to extend parallel to the direction of the pole 102, the antenna members 110 are also preferably located within 3 diameters of the pole 102. Specifically, in this preferred embodiment, the pole has a diameter of between approximately 7.6 and 9 inches where the sleeve 120 is mounted on the pole 102. The antenna members 110 are mounted on the antenna mounting members 128 which are positioned on the brackets 124 that extend outward from the pole 102 six (6) inches. Hence, the antenna mounting apparatus 100 present a sleek, streamlined appearance as a result of the antenna members 110 being positioned substantially adjacent the pole 102.

The foregoing description has described an antenna member comprised of two receive antennas and a single transmit antenna. It should be appreciated that the sleeve 120 and/or antenna mounting members 128 can be lengthened to accommodate a member having more receive antennas while still maintaining the desired separation therebetween without departing from the scope of this invention. Further, the present invention is not limited to the antenna members described above, but can also accommodate discrete antennas positioned at intervals along the antenna mounting member 128 and other pieces of equipment.

FIGS. 2 and 3 further illustrate that the center of the pole 102 is hollow and contains cables 134 which are connected to each of the antenna members 110. In this preferred embodiment, these cables interconnect the antenna members 110 to a ground station (not shown) which can be positioned nearby the antenna assembly 90. For cellular communication networks, the ground station provides an interconnection to the publicly switched telephone network. The size, type and number of cables interconnecting the antenna to the ground station is dependent upon the type of antennas used in a particular installation.

This embodiment of the antenna mounting apparatus 100 includes a conical rain cap 136 which is positioned on the top of the sleeve 120 to protect the cables 134 from exposure to the elements. In this embodiment, the conical rain cap 136 is approximately 20 inches in diameter and has two supports 138 attached to the underside of the cap 136 which are used to mount the cap to the sleeve 120.

The sleeve 120 is preferably rotatable about an axis defined by the pole 102 so that a person can easily orient the sleeve 120 into a desired orientation while the sleeve 120 is supported by the support member 112. As can be appreciated, it may be desirable to include bearings or lubrication, such as teflon coating, on the top of the collar 112 or the bottom of the sleeve 120 to facilitate rotational movement of the sleeve 120.

Further, it may also be desirable to position a bearing assembly 142, which is illustrated in FIG. 2C, between the support member 112 and the sleeve 120 so that the sleeve 120 can be easily rotated about the pole 102. The bearing assembly 142 includes a first bearing ring 143 and a second bearing ring 144 and a plurality of ball bearings 145 interposed therebetween. The second bearing ring 144 rotates on the ball bearings with respect to the first bearing ring 143. The inner diameter of the bearing assembly 142 is preferably substantially the same as the outer diameter of the pole 102 at the position of the mounting collar 112. The bearing assembly 142 is positioned around the pole 102 so that the first bearing ring 143 rests upon the support collar 112. The sleeve 120 is preferably slid down over the top of the pole so that the bottom edge of the sleeve 120 rests upon the second bearing ring 144. As is illustrated in FIG. 2C, the second bearing ring 144 is preferably angled so that as the sleeve 120 is lowered onto the second bearing ring 120, the sleeve 120 is automatically centered about the pole 102. Since the second bearing ring 144 can rotate with respect to the first bearing ring 143, the worker installing the sleeve 120 can orient the sleeve in a desired rotational orientation once it is positioned on the bearing assembly 142 by simply rotating the sleeve 120 on the bearing assembly 142.

The sleeve 120 preferably includes a locking mechanism designed to secure the sleeve in the desired rotational orientation. As shown in FIGS. 2 and 2B a plurality of locking bolts 140 are circumferentially positioned on the sleeve 120 so that a bolt 140 is positioned at a point midway between each of the pair of brackets 124 for a total of six locking bolts 140. As is shown specifically in FIG. 2B, the locking bolts 140 extend inward into the pole 102 so that the locking bolts 140 can be tightened against the pole 102. Hence, once the sleeve 120 has been positioned in the desired rotational orientation, the locking bolts 140 can then be tightened to secure the sleeve 120 in this position.

The foregoing description has described one embodiment of the antenna mounting apparatus 100 of the present invention. This embodiment can be easily installed onto an existing pole or onto a newly installed pole by simply installing the collar 112 onto the pole 102, sliding the sleeve 120, with the attached antenna mounting members 128, over the top of the pole 102 onto the collar 112. Once the sleeve 120 is positioned on the collar 112, the sleeve 120 is rotated into a proximate rotational orientation about the pole 102 and the antenna members 110 are mounted on the antenna mounting members 128 and connected to the cables 134 extending from the top of the pole 102. After the antenna members 110 have been mounted and connected to the cables 134, the antenna mounting apparatus 100 which is supported by the support collar 112, is then rotated into a desired rotational orientation to maximize the performance of the antennas in the antenna members 110. Subsequently, the locking bolts 140 are then tightened to secure the sleeve 120 and the antennas in this rotational orientation. It should be appreciated that the present invention is not limited to using the support member 112 shown in FIG. 2, but, in fact, can be practiced using any sort of support which is capable of retaining the antenna mounting apparatus 100 and the antenna members 110 in a desired position on the pole 102.

Hence, the apparatus 100 of the present invention is easy to install as it simply has to be positioned on the support member 112 and, while supported thereby, rotated into a desired position and secured in this position. If, at a later time, the antennas need to be re-oriented, a technician simply has to loosen the locking bolts 140 and rotate the sleeve 120 into the new desired orientation.

Figure 4:
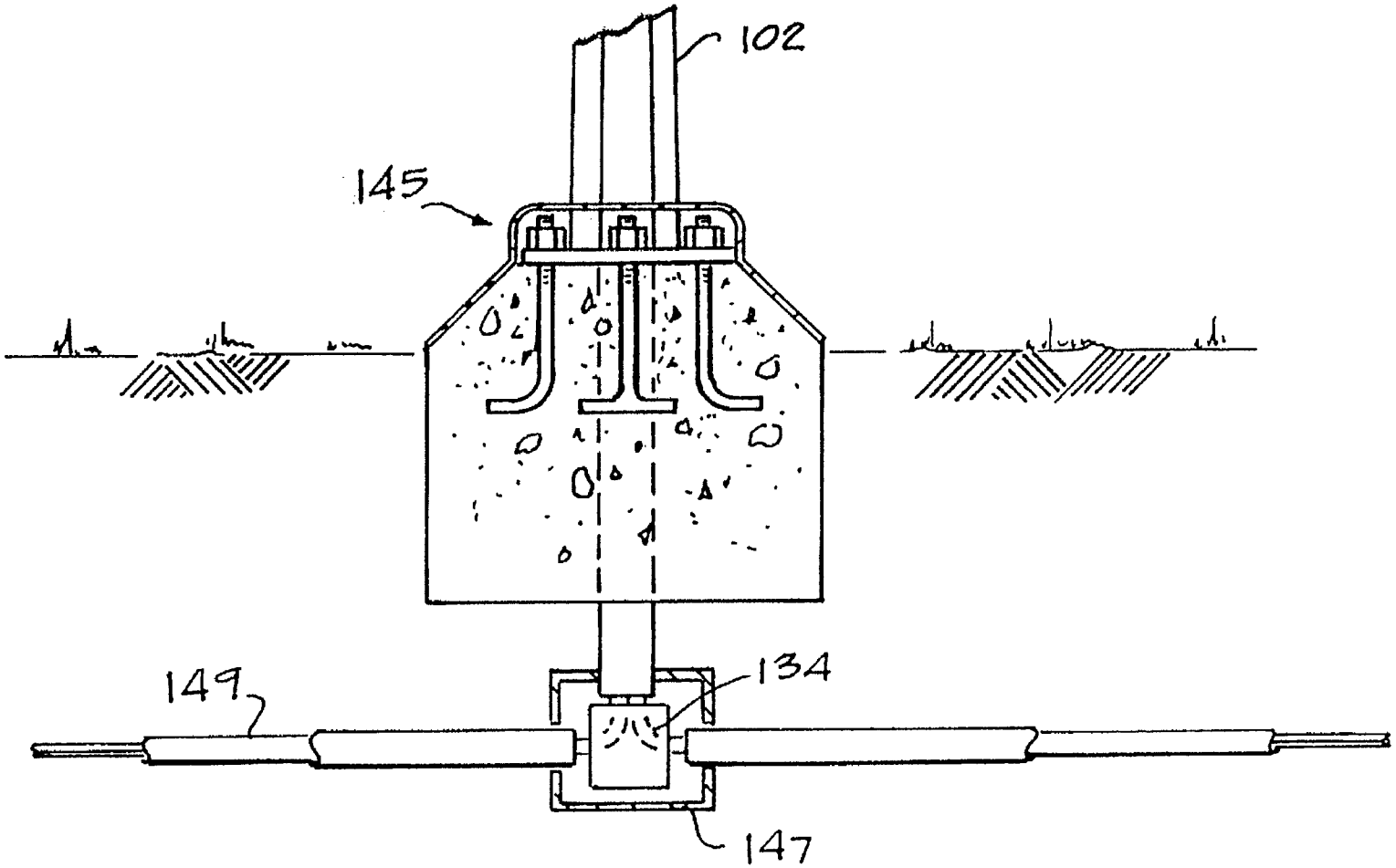
FIG. 4 is a partial side cut-a-way view of the apparatus and pole in FIG. 1 showing the pedestal of the pole in FIG. 1 and illustrating the installation of the antenna and power cables in the pole.

FIG. 4 illustrates a base 145 and a substructure 147 of the pole 102 shown in FIG. 1. The pole 102 can be erected and supported in a vertical position in the usual manner. The cables 136 for the antennas are then pulled through the pole 102 to the position of the antenna mounting apparatus 100. In the case of the embodiment shown in FIG. 1, the cables 136 are pulled through the pole 102 to the very top portion of the pole 102. As is shown in FIG. 4, the cables 136 134 are generally run in conduit underground from the base of the pole 102 to a base station (not shown) located nearby the antenna assembly 90.

Advantageously, the antenna mounting apparatus 100 is adaptable to be used on poles 102 that can also be used for other purposes. For example, in FIG. 1, the pole 102 also supports the traffic light 106. FIG. 4 illustrates that power and control wiring 149 for the traffic light 106 can also be pulled from underground conduit into the interior of the pole 102.

Figure 6:
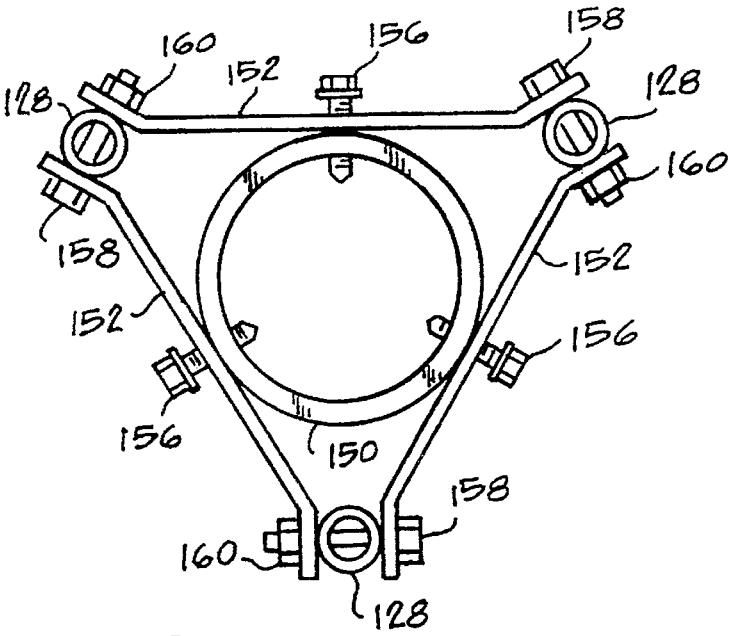
FIG. 6 is a top view of one of the collar assemblies comprising a portion of the antenna mounting apparatus of FIG. 5.
Figure 5:
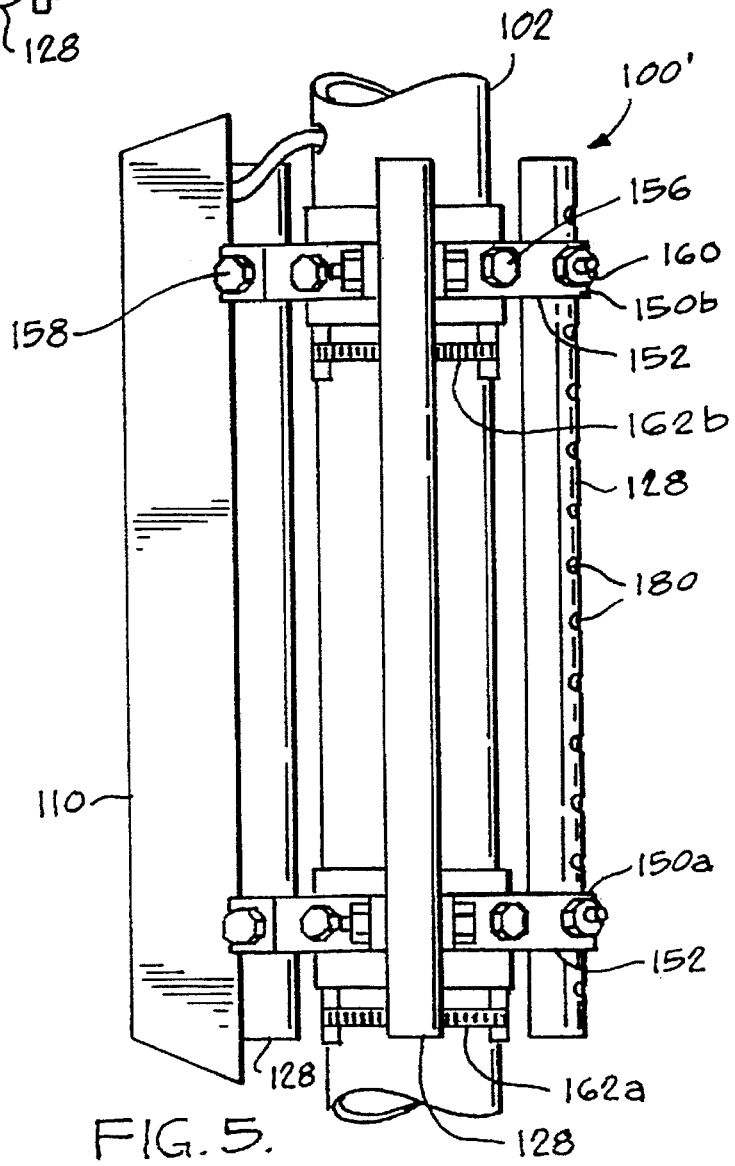
FIG. 5 is a partial perspective view of the pole and another preferred embodiment of an antenna mounting apparatus.
Figure 7:
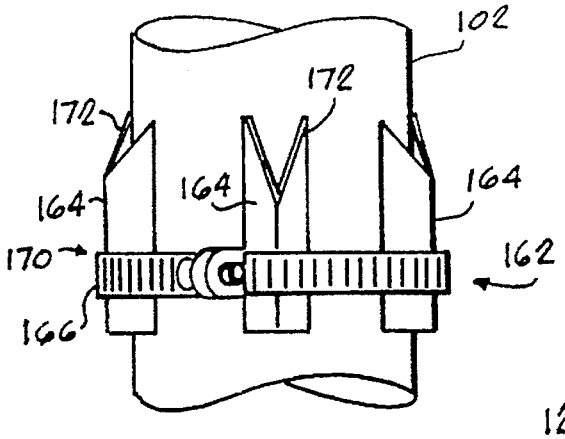
FIG. 7 is a detail view of one of the mounting strap assemblies comprising a portion of the antenna mounting apparatus of FIG. 6.

FIGS. 5, 6 and 7 illustrate another preferred embodiment of an antenna mounting apparatus 100'. Advantageously, this embodiment of the antenna mounting apparatus 100' can be easily adjusted in the field to accommodate antenna members 110 of different sizes. As shown in FIG. 5, the antenna mounting apparatus 100' includes two sleeves 150*a* and 150*b* which are sized to fit around the pole 102 and are generally cylindrical in shape. In this description, there are two sleeves 150*a* and 150*b* which are substantially identical in construction and are generally referred to in this description by the reference numeral 150. In the preferred embodiment shown in FIGS. 5 and 6, the sleeves 150 are configured to loosely fit around a pole 102 with approximately a 9-inch diameter to allow the sleeves to be easily positioned on the pole 102 and securely retained thereon in the manner described below. The sleeve 150 can be made out of any suitable material and has an inner diameter of approximately 9 inches, and is approximately 4 inches in length.

Three braces 152 are attached to each of the sleeves 150. As is shown more clearly in FIG. 6, each brace 152 is flanged outward at either end and is connected to the sleeve 150 via a set bolt 156 which extends through a hole in substantially the middle of the brace 152 into and through a hole in the sleeve 120. As shown in FIG. 6, the ends of the braces 152 are connected to an antenna mounting member 128. Specifically, the flange portions of each of the braces 152 have a hole for a bolt 158 which extends through the braces 152 and the antenna mounting member 128 and is then secured by a lock nut 160. Hence, the antenna mounting assembly 100' shown in FIGS. 5 and 6 preferably has three vertically extending antenna mounting members 128 positioned at approximately 120° intervals around the sleeves 150. The antenna members 110 can then be attached to the antenna mounting members 128 in the previously described manner.

The antenna mounting assembly 100' is mounted on a pole 102 in the following manner. Initially, an adjustable support member 162*a* is positioned on the pole 102 adjacent the desired position of the bottom sleeve 150*a*. In this description, there are two support members 162*a* and 162*b* which are substantially identical in construction and are generally referred to in this description by the reference numeral 162. An exemplary support member 162 used with this embodiment of the present invention is shown in FIG. 7. The support member 162 is essentially comprised of a plurality of cut wedges 164 and a stainless steel hose clamp 166. The cut wedges 164 preferably have an L-shaped cross section and have a cutout 170 to receive the hose clamp 166. Further, the cut wedges have an angled portion 172 which are configured to center the sleeve 150 when the sleeve 150 is positioned about the pole 102.

The wedges 164 of the bottom support member 162*a* are spaced around the pole 102 in a position immediately beneath the desired position on the pole 102 for the bottom sleeve 150*a* in the manner shown in FIG. 5. Once the wedges 164 are appropriately positioned, the hose clamp 166 is positioned in each of the cutouts 170 on the wedges and the hose clamp 166 is then tightened. As the hose clamp 166 is tightened, the wedges 164 are urged against the pole 102 and are thus securely held in position.

Once the support member 162*a* is positioned on the pole, the bottom sleeve 150*a* can then be slid over the top of the pole 102 until it is supported by the angled portions 172 of the wedges 164 of the support member 162*a* in a position where the bottom sleeve 150*a* is centered about the pole 102. Once the first support member 162*a* and the first sleeve 150*a* are positioned on the pole 102, the second support member 162*b* and the second sleeve 150*b* can be installed on the pole 102 in a desired position in a similar fashion. It should be appreciated that the second support member 162*b* can be correctly positioned by either making measurements or by assembling the apparatus 100' and determining the correct position on the pole 102 for the second support member 162*b* to adequately support the second sleeve 150*b*. After both the support members 162 and sleeves 150 have been installed, the antenna mounting members 128 can be attached to the braces 152 to thereby extend between the sleeves 150*a* and 150*b*. Subsequently, the antenna members 110 can then be mounted on the antenna mounting members 128.

Thus, in this preferred embodiment, the support members 162*a* and 162*b* must be sufficiently strong to support the weight of the rest of the antenna mounting apparatus 100' and the antenna members 110. It should be appreciated that the present invention is not limited to using both the support members shown in FIG. 7, but, in fact, can be practiced using any sort of support which is capable of retaining the antenna mounting apparatus 100' and the antenna members 110 in a desired position on the pole 102.

Once the antenna mounting apparatus 100' has been positioned on the pole 102 and the antenna members 110 have been mounted on the apparatus 100', the apparatus can then be rotationally oriented about the pole to maximize the performance of the antennas. Again, the support collars 162*a* and 162*b* can include lubrication to facilitate rotating the sleeve 120 about the pole 102 so that the correct rotational orientation can be easily attained. After the apparatus 100' has been rotationally oriented, the set bolts 156 are then tightened into the pole 102 to secure the apparatus 100' in the desired orientation. Naturally, if the apparatus 100' needs to be subsequently reoriented, the set bolts 156 simply have to be loosened to allow for reorientation of the antenna mounting apparatus 100'.

A person skilled in the art can appreciate that the embodiment of the antenna mounting apparatus 100' illustrated in FIGS. 5–7 is adjustable for antenna member 110 of differing height and also for limited available space on the pole 102. Specifically, since there are two separate sleeves 150*a* and 150*b*, they can be spaced at different distances apart, depending upon the application, and still provide support at substantially both ends of the antenna mounting members 128. For example, if there is insufficient space on the pole 102 to mount the sleeve 120 of the antenna mounting apparatus 100 shown in FIGS. 1 and 2, the antenna mounting apparatus 100' shown in FIGS. 5 and 6 can be adapted to be positioned on the pole 102.

Specifically, the two sleeves 150*a* and 150*b* simply have to be positioned on the pole 102 closer together and the antenna mounting members 128 either have to be cut to size or attached to the braces 152 at positions closer to the center of the antenna mounting members 128. FIG. 5 illustrates that one of the antenna mounting members 128 includes a plurality of holes 180 configured to receive the bolt 158 which attached the members 128 to the braces 152. This allows the installer to connect the braces 152 to different positions on the antenna mounting member 128. A person skilled in the art could also appreciate that the mounting members 128 could also be made to be telescoping or expandable and contractible to permit the mounting members 128 to be mounted between the sleeves 150 over a range of separation of the sleeves 150. Further, the antenna mounting assembly 100' can also be adapted for antenna members of different sizes or individual antennas requiring different separation distances by using either longer or shorter antenna mounting members 128. Hence, the embodiment of the antenna mounting apparatus 100' is configured to allow the installer to adapt the apparatus 100' to be used in a variety of different circumstances while the installation is in progress.

Figure 8:
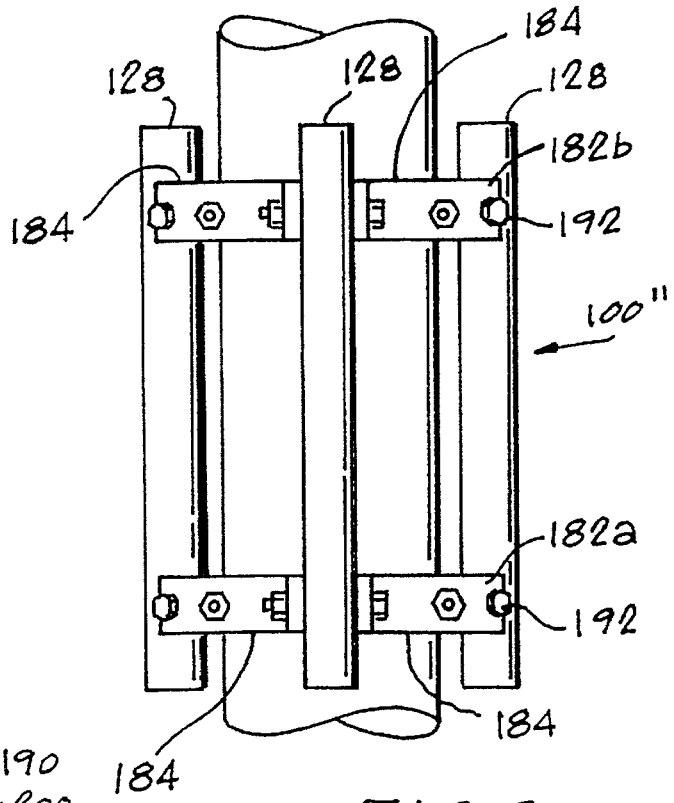
FIG. 8 is a partial perspective view of the pole and another preferred embodiment of an antenna mounting apparatus.
Figure 9:
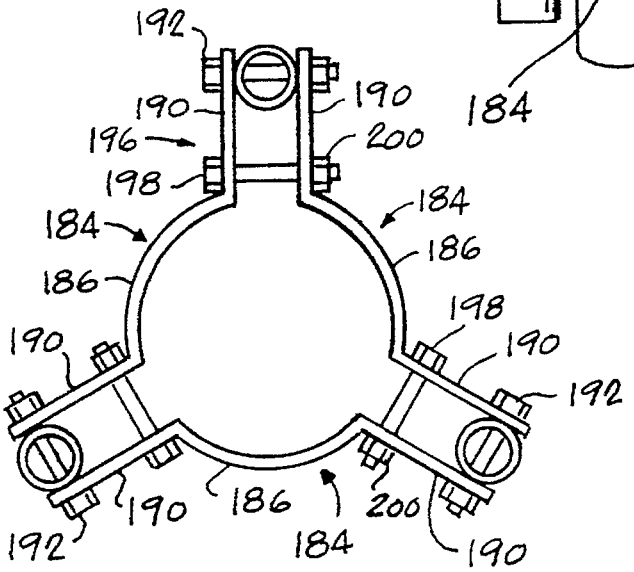
FIG. 9 is a top view of one of the collar assemblies comprising a portion of the antenna mounting apparatus of FIG. 8.

FIGS. 8 and 9 illustrate a third preferred embodiment of an antenna mounting apparatus 100". This embodiment includes two sleeves 182*a* and 182*b*. In this embodiment there are two substantially sleeves 182*a* and 182*b* which in this description are generally referred to by the reference numeral 182. The sleeves 182 are preferably comprised of three generally "W" shaped brace members 184 (See, FIG. 9). The brace members 184 are preferably made out of a flexible material such as steel or aluminum and have a curved center section 186 and two arms 190 at either ends of the center section 186. The arms 190 on the brace members 184 are configured to receive a mounting bolt 192 which connects an antenna mounting member 128 to two of the brace members 184 in the manner shown in FIGS. 8 and 9. Hence, the arms of the three brace members 184 are connected to three antenna mounting members 128, which are preferably positioned at 120° intervals around the circumference of the pole 102.

The brace members 184 are also configured to receive a clamp assembly 196. The clamp assembly 196 clamps the sleeve 182 against the pole 102 and thereby secure the antenna mounting apparatus 100" on the pole 102. In the preferred embodiment shown in FIGS. 8 and 9, the clamp assembly 196 is comprised of three bolt 198 which extend through a hole in the arm 190 of each of the brace member 184 which are preferably immediately adjacent the center portion 186. The bolts 198 also extends through a similarly positioned hole in the next adjacent brace member 184 and lock nut 200 are then threaded onto the bolts 196. Tightening the bolts 198 and the nuts 200 results in the center portions 186 of the two interconnected brace members 184 drawing closer together and thereby clamping the sleeve 182 against the pole 102.

Hence, a sleeve 182 can be positioned on a pole 102 by simply installing the three brace members 184 around the pole 102, interconnecting the individual brace members 184 with the clamping assembly 196 and then tightening the clamping assembly 196 to securely connect the sleeves 182 to the pole 102. Once both sleeves 182*a* and 182*b* are connected to the pole 102, the antenna mounting members 128 can be connected to the sleeves 182*a* and 182*b* and the antenna members 110 can then be mounted on the members 128 in the previously described fashion. The antenna mounting apparatus 100" can be rotationally adjusted into a desired rotational orientation about the pole 102 by simply loosening the clamping assembly 196 on both sleeves 182*a* and 182*b* a sufficient amount to allow for rotation of the assembly 100". Once the apparatus 100" is in the desired orientation, the clamping assembly 196 can be tightened to secure the apparatus 100" in the desired position and rotational orientation on the pole 102.

This embodiment of the antenna mounting apparatus 100" can be positioned on a pole 102 without requiring the apparatus 100" to be slid over the top of the pole. This embodiment of the present invention can be positioned on any pole by simply interconnecting and clamping the brace members 184, which comprise each of the sleeves 182 to the pole 102 at the desired position on the pole 102. It can further be appreciated, that this embodiment of the apparatus 100" can be adapted for different sizes of antenna members 110, antenna arrays requiring different separation distances and different sized mounting locations in the same manner as the embodiment of the assembly 100' shown in FIGS. 5 and 6.

Figure 10:
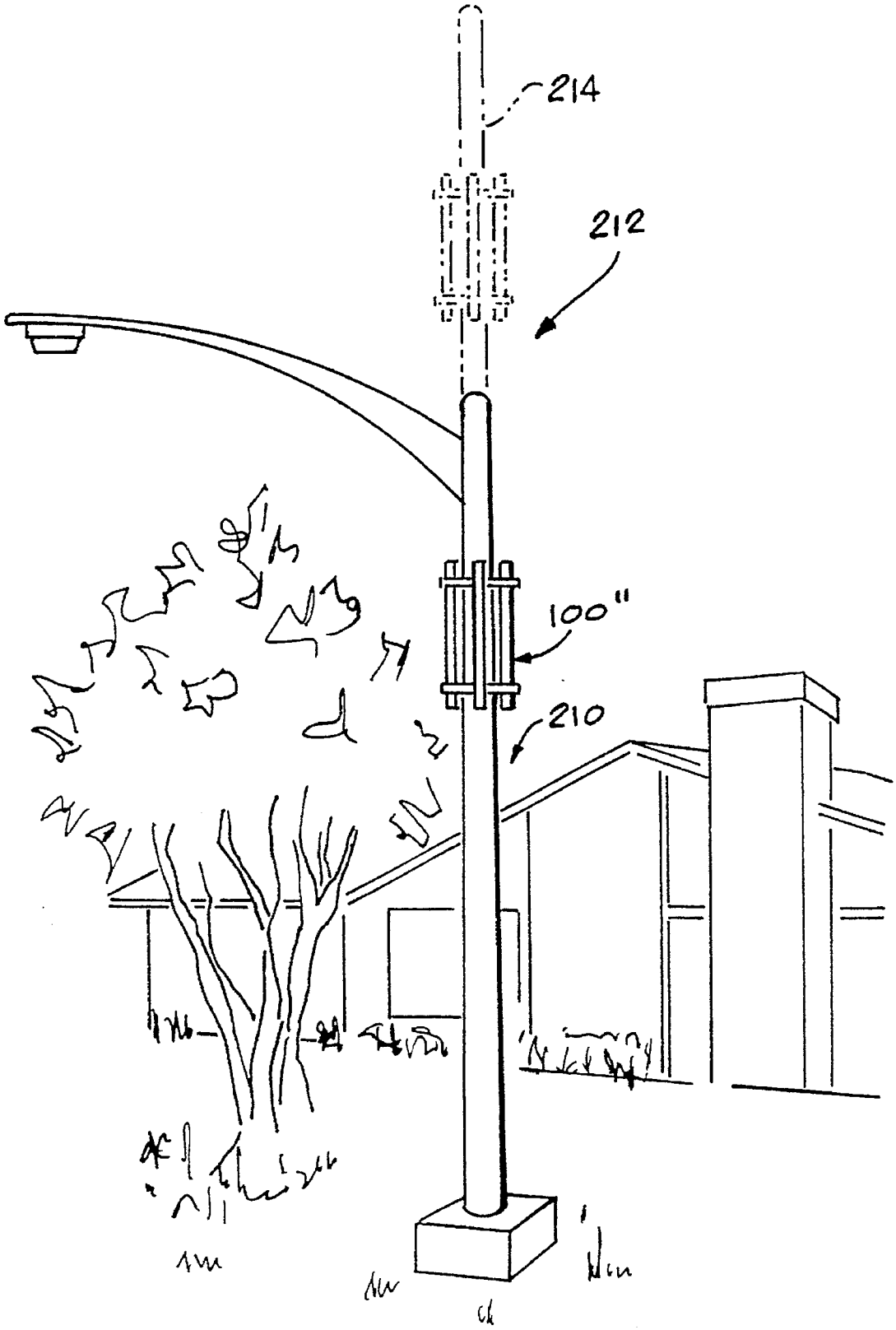
FIG. 10 is a perspective view of the third embodiment of an antenna mounting apparatus installed on a vertical section of a light pole.

As described above, the antenna mounting apparatuses 100, 100' and 100" can be either positioned on existing poles, or the existing pole can be replaced with a pole having a suitable mounting location for the antenna mounting apparatuses. FIG. 10 provides an example of how the mounting apparatus 100" can be positioned on an existing street light 210. The mounting apparatus 100" is positioned on the street light pole 210 beneath the horizontal cross beam. Naturally, the other embodiments of the mounting apparatus 100 and 100' could also be mounted in this position on the pole 102 by simply sliding the sleeves of the apparatus 100 or 100' over the pole prior to the installation of a light or other obstructing device. Another possible embodiment of the present invention is to replace the existing street light pole with a street light pole 212 that includes the vertical portion 214 represented in phantom in FIG. 10. This would allow an antenna mounting apparatus 100, 100' or 100" to be mounted at the top of the vertical section of the pole while still providing the horizontal cross section for the street light.

The foregoing description has described several embodiments of an antenna mounting assembly which can be used to mount antennas on either existing poles, newly constructed poles or new poles which provide platforms for the functions of existing poles, e.g., stoplights, streetlights, power supplies and the like, but include taller members to provide a platform for antennas. The antenna assembly and antenna mounting apparatus of the present invention permits easy installation of the antenna arrays in urban and residential environments. The general method of installation of the antenna array is illustrated in FIGS. 11A–11D.

Figure 11A:
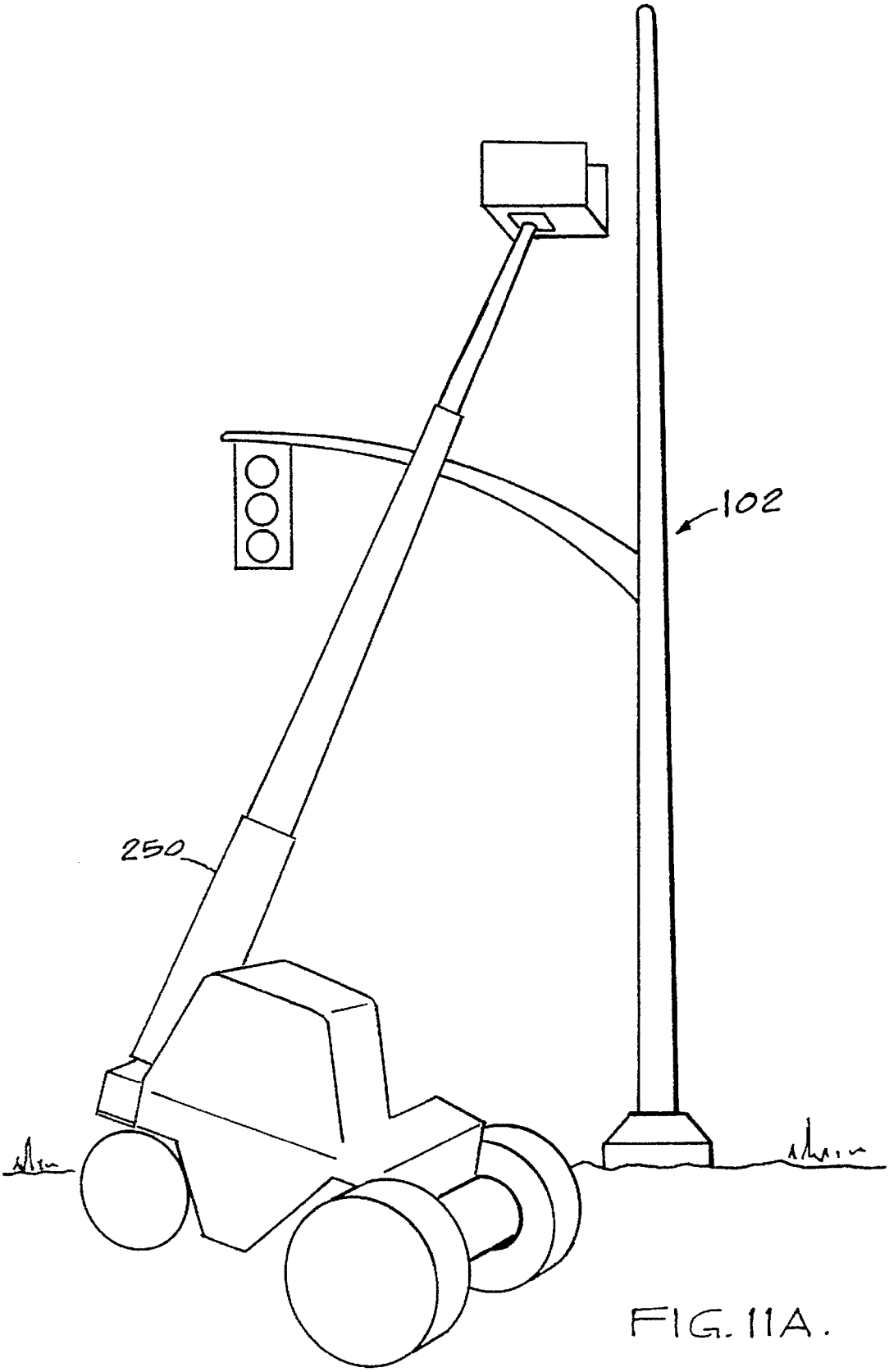
FIGS. 11A–11D illustrate a preferred method of installing an antenna mounting apparatus of the present invention.
Figure 11B:
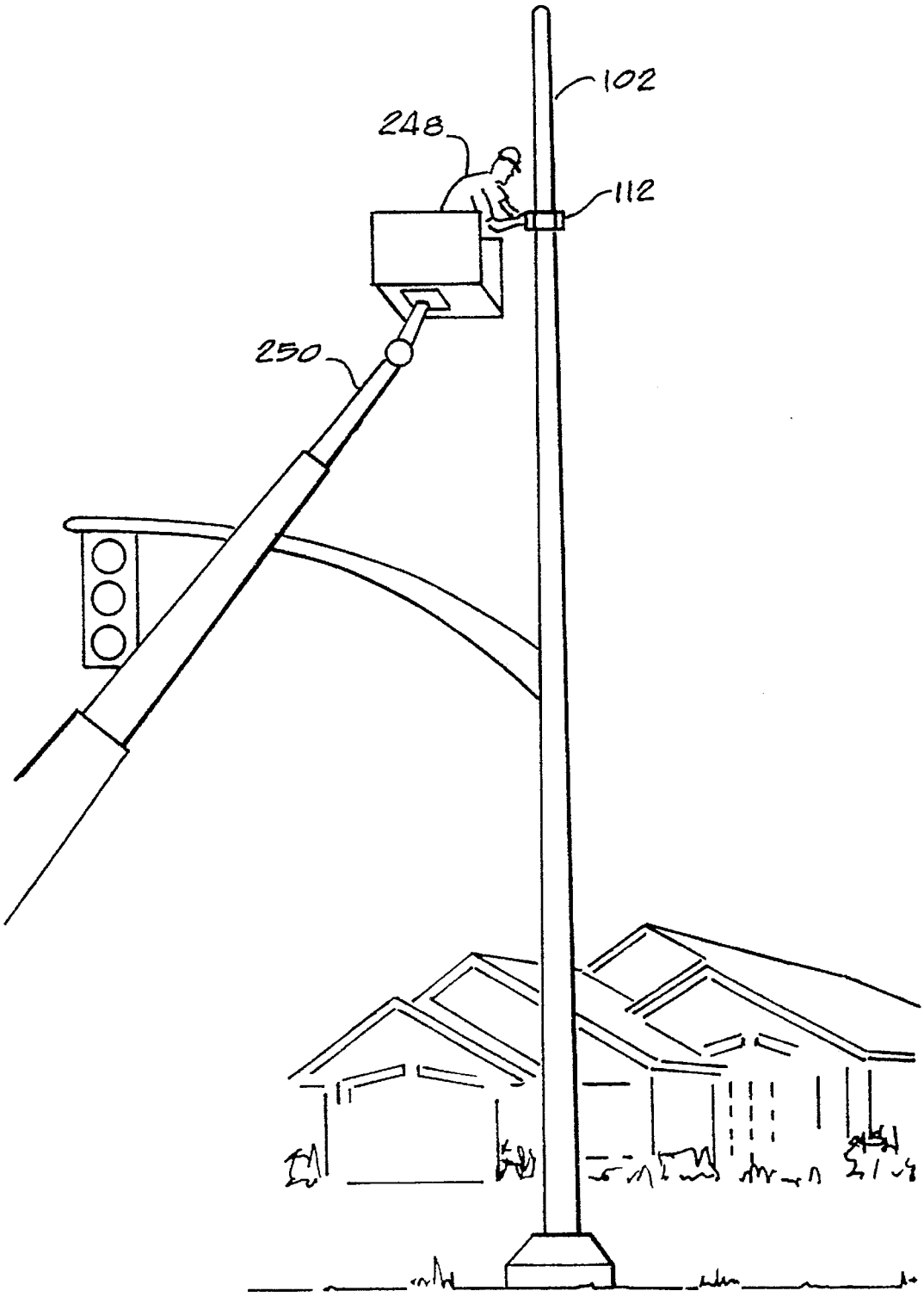

As shown in FIG. 11A, the first step in installing one of the antenna assemblies of the present invention is to provide a pole 102. The pole can either be an existing pole or a new pole that has been constructed and erected for the purpose of providing, among other things, a platform for an array of antennas. As shown in FIG. 11B, once the pole 102 has been erected, a support member can then positioned on the pole 102 by a worker 248 positioned in a cherrypicker vehicle 250. The type of support member varies depending upon which preferred embodiment of the apparatus is to be positioned on the pole 102. In the example shown in FIG. 11B, the support member is comprised of the support collar 112 of the first embodiment of the antenna mounting apparatus 100. Naturally, if the embodiment shown in FIGS. 8 and 9 are used, no support member is needed.

Figure 11C:
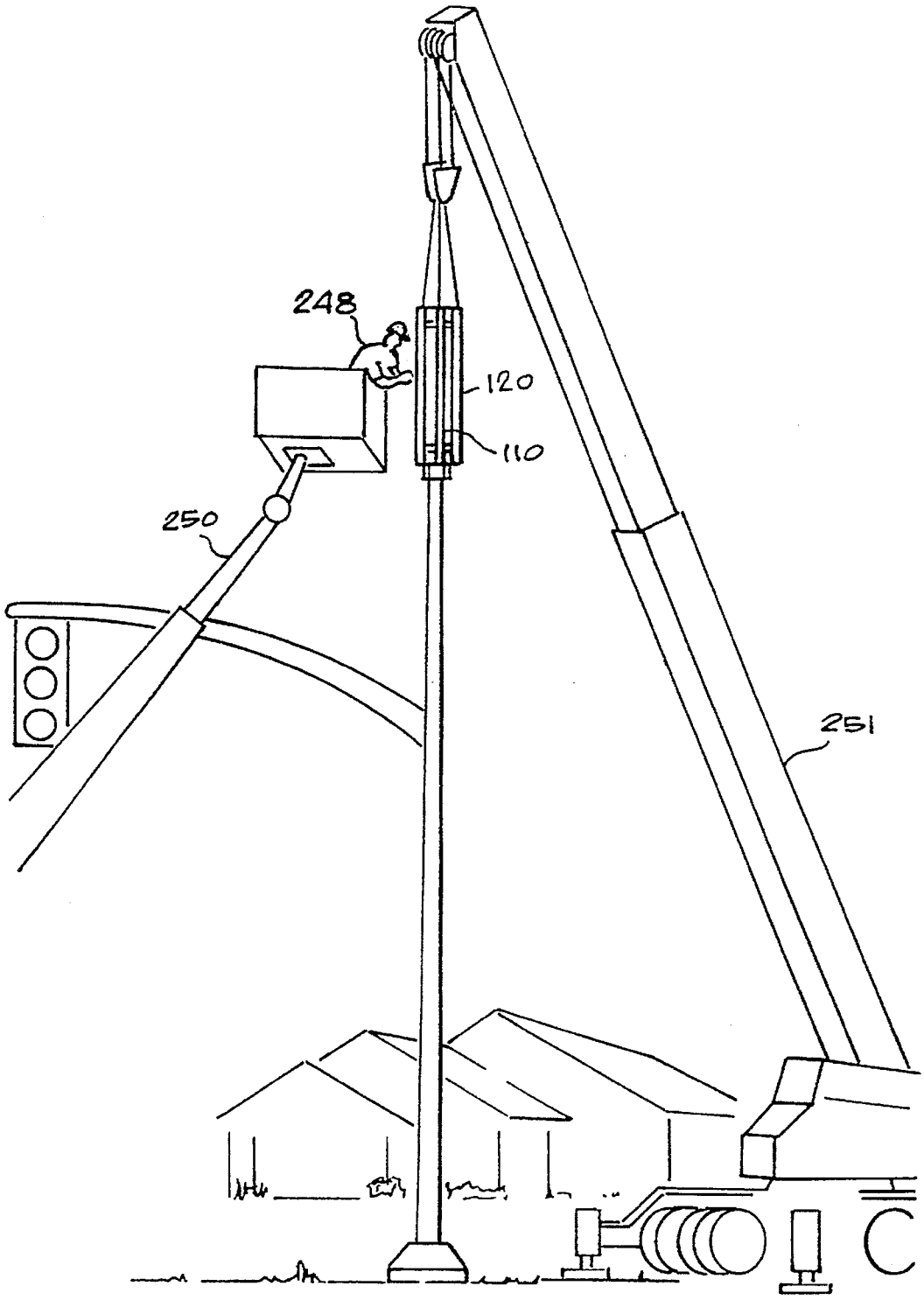

As shown in FIG. 11C, once the support member is positioned on the pole 102, a sleeve can then be lowered on the pole 102 by a crane 251 while guided by the worker so that it is then positioned on the pole so as to be supported by the support member. In FIG. 11C the single sleeve 120 is shown as being supported by the collar 120, however, if the second embodiment of the invention was used, two separate sleeves 150*a* and 150*b* would be supported by two separate support collars 162.

Figure 11D:
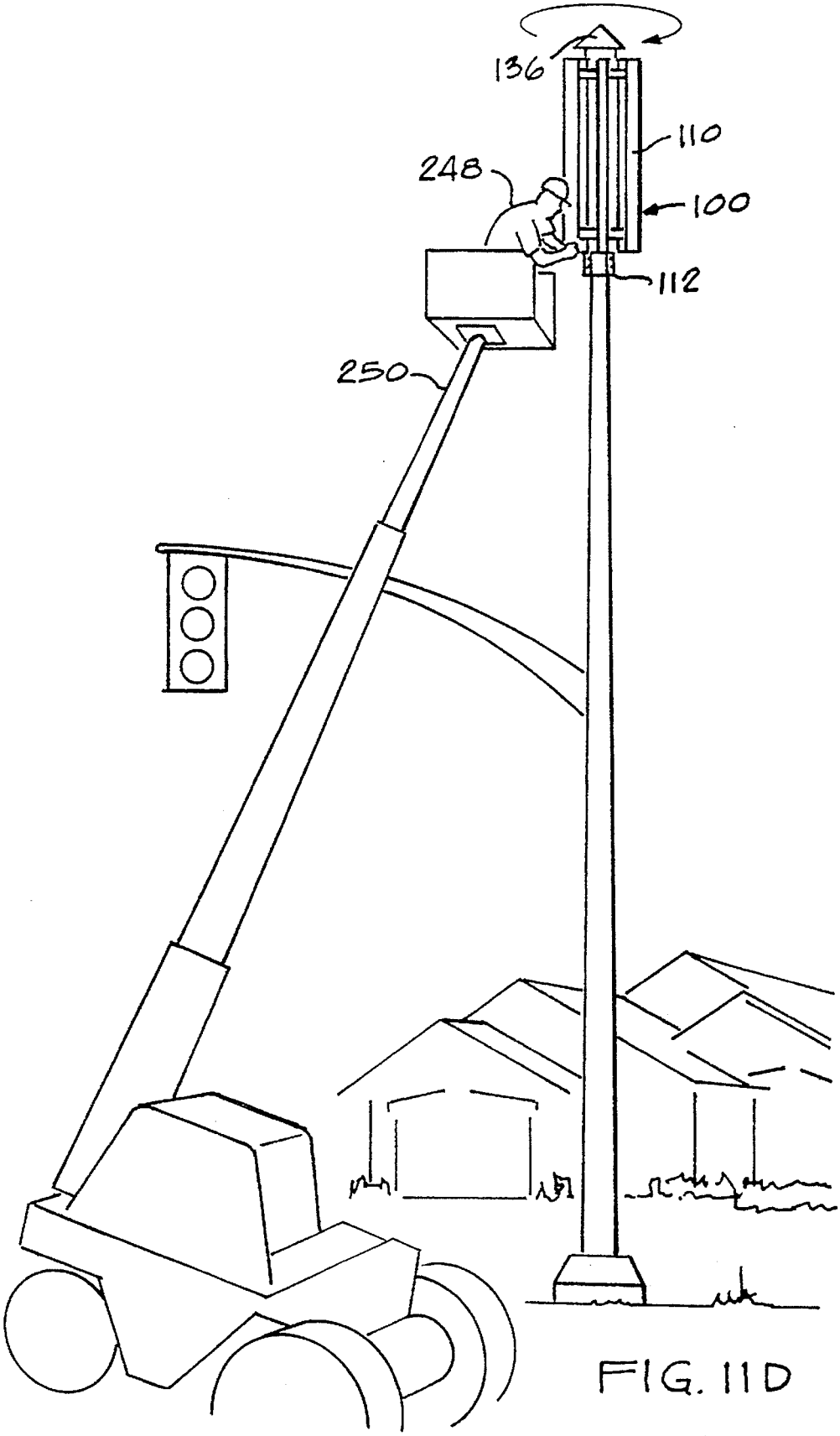

The antenna mounting members 128 and the antenna members 110 can then be mounted on the sleeve 120 in the manner shown in FIG. 11C. Alternatively, the antenna mounting members 128 and antenna members 110 can be mounted on the sleeve 120 prior to placing the sleeve 120 on the pole 102. Once the sleeve 120 is positioned on the pole with the antenna members 110 mounted on the sleeve 120, the cables 134 Can then be connected to the antennas and the cap 136 can then be positioned on the top of the pole 102 to protect the cables inside of the pole as is shown in FIG. 11D. Once the antenna arrays 110 are mounted and connected, the worker 248 can then orient the assembly in a desired rotational orientation for the antennas and then tighten the bolts 140 to secure the antenna mount apparatus 100 in the desired position. It should be appreciated that mounting the sleeve on the pole is facilitated by the pole being tapered as that makes it easier to guide the sleeve over the top of the pole. Further, correctly positioning the sleeve can also be facilitated by mounting the sleeve on self-centering supports and rotating supports like those described herein.

Hence, the present invention provides for a simple and efficient method of mounting antennas. This method can be accomplished without requiring the construction of a complicated tower to hold the antenna arrays and it can even be accomplished using existing light and power poles.

Although the foregoing description of the preferred embodiments of the present invention has shown, described and pointed out the fundamental novel features of the invention, it will be understood that various omissions, substitutions and changes in the form of the detail of the apparatus as illustrated, as well as the uses thereof, may be made by those skilled in the art, without departing from the spirit of the present invention. Consequently, the scope of the invention should not be limited to the foregoing discussion, but should be defined by the appended claims.

What is claimed is:

1. An equipment mounting assembly comprising:

a support member which is adapted to be fixedly positioned on an upwardly extending pole;

an equipment mount having an opening to receive said upwardly extending pole wherein said equipment mount is configured to rotate about said upwardly extending pole and said equipment mount provides a surface on which a piece of equipment can be mounted; and a securing mechanism which engages with said equipment mount and said upwardly extending pole so that said securing mechanism can be manipulated to prevent said equipment mount from rotating about said upwardly extending pole.

2. The assembly of claim 1, wherein said equipment mount is a first sleeve which is positioned about said upwardly extending pole in a first position and said support member is configured so that when said equipment mount is positioned in said first position, said support member urges said first sleeve into an orientation about said pole where said first sleeve is substantially centered about said pole.

3. The assembly of claim 1, wherein said support member is a collar configured to fit around said upwardly extending pole.

4. The assembly of claim 3, wherein said equipment mount has a first edge which engages with said collar so that said equipment mount can rotate about said pole while said first edge and said collar are engaged.

5. The assembly of claim 4, wherein lubrication is provided between said first edge of said equipment mount and said collar to facilitate rotational movement of said equipment mount about said upwardly extending pole.

6. The assembly of claim 4, further comprising a bearing assembly which engages with said first edge of said equipment mount and said collar to facilitate rotational movement of said equipment mount about said upwardly extending pole.

7. The assembly of claim 6, wherein said equipment mount comprises a first sleeve which is positioned in a first position about said upwardly extending pole and said bearing assembly is configured to urge said sleeve into an orientation about said pole where said first sleeve is substantially centered about said pole.

8. The assembly of claim 1, wherein said equipment mount is comprised of a first sleeve which is co-axially positioned at a first position about said pole.

9. The assembly of claim 8, wherein said first sleeve includes an equipment mounting surface where said piece of equipment can be mounted on said equipment mounting surface and wherein said piece of equipment has an elongated configuration and said piece of equipment is mounted on said equipment mounting surface so that the elongated portion of said piece of equipment extends in a direction which is substantially parallel to the direction of said upwardly extending pole.

10. The assembly of claim 9, wherein said at least one equipment mounting surface is positioned relative said first sleeve so that said piece of equipment is positioned substantially adjacent said first sleeve.

11. The assembly of claim 10, wherein said first sleeve defines a diameter distance which comprises the diameter of said sleeve and said piece of equipment is positioned within three diameter distances of an outer surface of said first sleeve.

12. The assembly of claim 11, wherein said at least one piece of equipment comprises an elongated antenna member having a plurality of antennas disposed therein.

13. The assembly of claim 12, wherein said antenna member includes a first and second receive antennas which are positioned at opposite ends of said antenna member and a transmit antenna interposed between said first and second receive antennas.

14. The assembly of claim 8, wherein said equipment mount comprises said first sleeve and a second sleeve and wherein said second sleeve is positioned at a second position on said pole.

15. The assembly of claim 14, wherein said equipment mount includes at least one equipment mounting member extending between said first sleeve and said second sleeve in a direction substantially parallel to said upwardly extending pole.

16. The assembly of claim 15, wherein said piece of equipment has an elongated configuration and said piece of equipment is mounted on said equipment mounting member so that the elongated portion of said piece of equipment extends in a direction substantially parallel to said pole.

17. The assembly of claim 16, wherein said elongated piece of equipment comprises an elongated antenna member.

18. The assembly of claim 1, wherein said securing mechanism is comprised of at least one bolt which extends through said equipment mount and selectively engages said pole to prevent rotational movement of said equipment mount.

19. A method of mounting equipment on an upwardly extending pole comprising the steps of:

providing an upwardly extending pole;

positioning a first support member on said upwardly extending pole;

positioning a first equipment mount having a surface on which equipment can be mounted on said upwardly extending pole in a first position where said first equipment mount is supported by said first support member;

rotating said first equipment mount into a first desired rotational orientation about said upwardly extending pole; and securing said first equipment mount into said first desired rotational orientation.

20. The method of claim 19, wherein said step of providing a pole comprises providing a pole which includes a platform for said first equipment mount and a platform for a stoplight.

21. The method of claim 19, wherein said step of providing a pole comprises attaching a new vertical section to an existing pole which has an existing vertically extending section and an existing horizontally extending section.

22. The method of claim 19, wherein said step of positioning a first equipment mount on said upwardly extending pole comprises positioning a first sleeve at a first position on said pole so that said first sleeve is supported by said support member.

23. The method of claim 22, wherein said step of positioning a support member on said pole comprises positioning a first collar on said pole so that said first collar maintains said first sleeve in said first position on said pole.

24. The method of claim 23, wherein said first collar is configured to urge said first sleeve into an orientation where said first sleeve is substantially centered about said pole.

25. The method of claim 23, wherein first sleeve has a first edge which engages with said first collar so that said first sleeve can rotate about said pole while said first edge and said first collar are engaged.

26. The method of claim 25, wherein lubrication is provided between said first edge of said first sleeve and first collar to facilitate rotational movement of said first sleeve about said upwardly extending pole.

27. The method of claim 25, further comprising the step of positioning a bearing assembly so as to engage with said first edge of said first sleeve and said first collar to facilitate rotational movement of said equipment mount about said upwardly extending pole.

28. The method of claim 27, wherein said bearing assembly is configured to urge said first sleeve into an oriention where said first sleeve is substantially centered about said pole.

29. The method of claim 19, further comprising the steps of:

positioning a second support member on said upwardly extending pole; and positioning a second equipment mount on said upwardly extending pole in a second position, where said second equipment mount is supported by said second support member, and wherein said second equipment mount has a surface on which equipment can be mounted.

30. The method of claim 29, wherein said surface on which equipment can be mounted on both said first and said second equipment mounts comprises a member which extends between said first and said second equipment mounts.

31. The method of claim 19, further comprising the step of positioning equipment on said equipment mount.

32. The method of claim 31, wherein said piece of equipment has an elongated configuration and said piece of equipment is positioned on said equipment mount so that the elongated portion of said piece of equipment extends in a direction which is substantially parallel to the direction of said upwardly extending pole.

33. The method of claim 32, wherein said equipment mount comprises a sleeve defining a diameter distance comprising the diameter of said sleeve and said elongated piece of equipment is positioned within three diameter distances of said sleeve.

34. The method of claim 32, wherein said elongated piece of equipment comprises an antenna member having an elongated configuration.

35. An antenna assembly comprising:

a pole extending in a first direction;

an antenna mount positioned on said pole wherein said antenna mount includes an antenna mounting surface;

an elongated antenna member having a first receive antenna positioned at a first end of said antenna member and a second receive antenna positioned at a second end of said antenna member and a transmit antenna interposed between said first and said second receive antenna, wherein said elongated antenna member is mounted on said antenna mount so that said antenna member extends in a direction which is subtantially parallel to said first direction.

36. The assembly of claim 35, further comprising a support collar positioned on said pole which maintains said antenna mount at a first position on said pole.

37. The assembly of claim 36, wherein said antenna mount is rotatable about said pole while supported by said support collar.

38. The assembly of claim 37, further comprising a securing mechanism engaged with both said antenna mount and said pole which can be manipulated to prevent rotation of said antenna mount about said pole to thereby secure said antenna mount in a desired rotational orientation.

39. The assembly of claim 35, wherein said antenna mount comprises a first sleeve adapted to slip over said pole.

40. The assembly of claim 39, wherein said first sleeve includes an antenna mounting member which extends in a direction which is substantially parallel to said first direction.

41. The assembly of claim 40, wherein said first sleeve defines a diameter distance which is substantially equal to the diameter of said sleeve and said antenna member is mounted on said antenna mounting member so that said antenna member is within three diameter distances of said sleeve.

42. The assembly of claim 35, wherein said antenna mount is comprised of:

a first and a second sleeve which are respectively positioned at a first position and a second position on said pole; and a antenna member extending between said first and said second sleeve to provide said antenna mounting surface.

43. The assembly of claim 42, further comprising a first and a second support member which respectively support said first and said second sleeve in said first and said second positions.

44. The assembly of claim 42, wherein said first and second sleeves members are each comprised of a plurality of brace members which are assembled to surround and securely clamp to said pole.

45. A method of mounting an antenna comprising the steps of:

providing a pole which extends in a first direction;

positioning an antenna mount having an antenna mounting surface on said pole; and positioning an elongated antenna member on said antenna mounting surface so that the elongated portion of said elongated antenna member extends in said first direction wherein said elongated antenna member includes a first receive antenna positioned at a first end of said antenna, a second receive antenna positioned at a second end of said antenna member and a transmit antenna interposed between said first and said second receive antennas.

46. The method of claim 45, further comprising the steps of:

rotationally orienting said antenna mount about said pole;

securing said antenna mount in a desired rotational orientation.

47. The method of claim 45, further comprising the step fo positioning a support collar on said pole wherein said support collar maintains said antenna mount at a first position on said pole.

48. The method of claim 45, wherein the step of mounting said antenna mount on said pole comprises:

mounting a first sleeve in a first position on said pole;

mounting a second sleeve in a second position on said pole; and interconnecting said first and said second sleeves with a member which defines said antenna mounting surface.

49. An equipment support assembly comprising:

a support clamp adapted to be clamped on a generally vertical pole and providing a support surface;

an equipment mounting sleeve having an upper an a lower edge, said sleeve adapted to slip over a generally vertical pole to be supported by said support surface of said support clamp in a fixed vertical position on said pole; and equipment mounting brackets extending along at least a portion of the length of said sleeve to support equipment.

50. The assembly of claim 49, wherein said support clamp comprises a collar wherein said lower edge of said sleeve engages with an upper surface of said collar to thereby support said sleeve.

51. The assembly of claim 50, wherein said upper surface of said collar is configured to urge said sleeve into a centered position about said pole when said lower edge of said sleeve engages with said upper surface of said collar.

52. The assembly of claim 51, wherein said equipment mounting brackets are configured to receive an elongated antenna member which includes a first and second receive antenna and a transmit antenna interposed between said first and second receive antennas.

* * * * *